United States Patent [19]

Abramson et al.

[11] Patent Number: 4,785,581

[45] Date of Patent: Nov. 22, 1988

[54] TILT-IN/TILT-OUT WINDOW ASSEMBLY WITH IMPROVED WEATHERSEAL GASKET

[75] Inventors: Steven R. Abramson, Rochester; Mark Clemenson, Farmington, both of N.Y.; Mark M. Kessler, Youngstown, Ohio

[73] Assignee: Pace Window & Door Corporation, Rochester, N.Y.

[21] Appl. No.: 56,730

[22] Filed: Jun. 2, 1987

[51] Int. Cl.[4] ..... E05D 15/22

[52] U.S. Cl. ..... 49/176; 49/388

[58] Field of Search ..... 49/388, 389, 176, 181

[56] References Cited

U.S. PATENT DOCUMENTS

| | | | |
|---|---|---|---|
| 690,417 | 1/1902 | Golden . | |
| 1,663,932 | 3/1928 | Ziganek et al. | 49/389 X |
| 1,873,066 | 8/1972 | Stewart . | |
| 2,666,235 | 1/1954 | Kaufman et al. . | |
| 2,752,642 | 7/1956 | Starck et al. . | |
| 2,778,068 | 1/1957 | Kaufman et al. | 49/181 |
| 3,055,063 | 9/1962 | Peters | 49/181 X |
| 3,135,014 | 6/1964 | Martin . | |
| 3,157,917 | 11/1964 | Peters . | |
| 3,299,573 | 1/1967 | Gustafson | 49/388 |
| 3,434,237 | 3/1969 | Love | 49/181 |
| 3,464,157 | 9/1969 | Rodriguez . | |
| 3,479,076 | 11/1969 | Schallehin . | |
| 3,482,354 | 12/1969 | Trout . | |
| 3,611,636 | 10/1971 | Trout . | |
| 3,789,549 | 2/1974 | Yip . | |
| 3,844,066 | 10/1974 | Nobes | 49/181 |
| 4,170,090 | 10/1979 | Wood . | |
| 4,226,050 | 10/1980 | Kessler . | |
| 4,271,631 | 6/1981 | Trout | 49/181 |
| 4,324,072 | 4/1982 | Sterner, Jr. . | |
| 4,364,199 | 12/1982 | Johnson et al. | 49/181 |
| 4,452,012 | 6/1984 | Deal . | |
| 4,555,868 | 12/1985 | Mancuso . | |

*Primary Examiner*—Philip C. Kannan

*Attorney, Agent, or Firm*—Browdy and Neimark

[57] ABSTRACT

A tilt-in/tilt-out window assembly with improved weather seal gasket includes a pivot bar having a particular cross-section and being integral with the lower frame member of the window sash. The pivot bar is adapted to be received in an aperture of a rotatable disk for pivotal movement within an adjacently opposing shoe integral with a channel formed in an adjacent jamb of the window assembly. A weather seal gasket, positioned on and entirely surrounding the pivot bar between the shoe of the jamb and the sash, includes a centrally located aperture therethrough having a configuration shaped to that of the pivot bar cross-section and a diameter or width at least equal to width of the channel opposing formed in the jamb. The gasket is adapted to seal the junction between the pivot bar and the shoe, thereby preventing the "chimney effect" and thereby improving insulation.

11 Claims, 2 Drawing Sheets

TILT-IN/TILT-OUT WINDOW ASSEMBLY WITH IMPROVED WEATHERSEAL GASKET

FIELD OF THE INVENTION

The present invention relates to tilt-in/tilt-out window assemblies of the extruded aluminum or vinyl type; and more particularly, to such assemblies embodying an improved weatherseal gasket positioned between the window sash and jamb for preventing passage thereabout of cold air with resultant penetration of such cold air from the outside to the inside.

BACKGROUND OF THE INVENTION

In recent years, there has been an increasingly high use of tilt-in/tilt-out window assemblies in office buildings and homes due to the ease of cleaning such window assemblies. Usually most of these types of window assemblies include a pair of pivot bars integrally formed in the sash at opposite sides of the window to be received in receiving apertures or shoes provided in the window jamb, thus permitting tilting of the window sash about the axis of the pivot bars. However, in modern vinyl and aluminum windows, there is typically a gap ranging from $\frac{1}{8}$ to $\frac{1}{4}$ inch between the sash surface supporting the pivot bar and the shoe, and this gap allows a "chimney effect" to occur in the track. Therefore, even when the window is in its closed position, air can penetrate between the frame and jamb especially in regions adjacent the junction of the pivot bars and the apertures or shoes of the window jamb. Particularly under conditions of extreme cold and/or wind, this area creates a substantial region of leakage thereby increasing homeowner cost because of necessary increased heating or cooling.

Over the years, there have been several attempts to block air gaps created between pivot bars and window jambs in tilt-in/tilt-out window assemblies. For example, the Yip U.S. Pat. No. 3,789,549 shows a tilt-in/tilt-out window assembly including pivot bars received within jamb locking members; weatherstripping is provided in the form of an elngated strip of relatively complex cross-section, which appears to be an extrusion. Similarly, in Wood U.S. Pat. No. 4,170,090, another relatively complex elongated profile is provided to accomplish a weatherstripping function for a double-hung slidable window assembly.

While such weatherstripping profiles will prevent considerable cold air penetration between the window jamb and sash, particularly when the window is in its closed position, some air can still penetrate through the window assembly at the regions surrounding the junction between the pivot bar and the aperture or shoe provided in the window jamb, i.e. the weatherstrippings employed in these patents are not gaskets and consequently do not completely encircle the pivot bars, thereby not fully sealing all the air gaps created therebetween. Moreover, these profiles are relatively expensive and increase the difficulty of constructing and assembling the windows.

U.S. Pat. Nos. 3,464,157 to Rodriguez; 3,482,354 and 3,611,636 to Trout; 3,844,066 to Nobes; 4,364,199 to Johnson et al; and 4,452,012 to Deal all show tilt-in/tilt-out double-hung, slidable window assemblies including brake shoes or nuts or clamping members in the window jamb for receiving the pivot bars of the window sash. However, while these pivot bar receiving elements have apertures for receiving the ends of the pivot bars, these elements are neither designed for nor do they carry out any effective sealing function, i.e. they do not eliminate the chimney gap between the shoe and jamb. None of these patents provide a gasket seal or other sealing means to seal the region adjacent the shoe, particularly at the regions receiving or encircling the pivot bars of the sash.

Other known patents disclosing double-hung, slidable tilt-in/tilt-out windows include the U.S. Pat. Nos. to Mancuso 4,555,868; Sterner 4,324,072; Kessler 4,226,050; and Stewart 1,873,066. While most of the patents noted above concern modern windows wherein the sash and jamb are both formed of vinyl or aluminum extrusions, certain of these relate to windows formed of wood. Of course, it will be understood that wooden windows are constructed differently, and the problem outlined above does not normally exist in window assemblies formed with wooden sashes and frames. Among these, there may be mentioned the U.S. Pat. Nos. to Golden 690,417; Martin 3,135,014; Peters 3,157,917; Starck et al 2,752,642; and Kaufman et al 2,778,068 and 2,666,235.

No tilt-in/tilt-out window assembly of extruded vinyl or aluminum has previously been available which employs a gasket seal between the junction of the pivot bar of the sash and the pivot-bar-receiving element provided in the jamb to prevent air passage therebetween and stop the "chimney effect". There has been a substantial need for suitable sealing means to prevent cold air ingress, such as a sealing gasket having an aperture therethrough for receiving and entirely encircling the pivot bar, particularly at the region where the pivot bar is received within a pivot-bar-receiving shoe or the like within the window jamb.

SUMMARY OF THE INVENTION

Accordingly, it is an object of the present invention to obviate deficiencies of the prior art, such as those set forth above.

It is a further object of the present invention to improve building insulation by reducing heat loss by air leakage past tilt-in/tilt-out windows.

It is another object of the invention to provide a weatherseal gasket or an improved weatherseal gasket for tilt-in/tilt-out window assemblies of the hollow frame type.

It is yet a further object of the present invention to provide an easily installed and inexpensive weatherseal gasket for tilt-in/tilt-out window assemblies of the hollow frame type.

It is still a further object of the present invention to provide improved tilt-in/tilt-out window assemblies of the hollow frame type having weatherseal gaskets each with an aperture for receiving and encircling the pivot bar of the sash.

It is another object of the present invention to provide a type of weatherseal gasket for tilt-in/tilt-out window assemblies of the hollow frame type which is of such a simple construction that many varieties of varying dimensions (to accommodate pivot bars of varying dimensional cross-sections) can be inexpensively made, stocked and used.

It is still another object of the present invention to provide a weatherseal gasket for use with tilt-in/tilt-out window assemblies especially of the hollow frame type which can entirely seal the junction between the pivot bar and the shoe or the like of the window jamb from air penetration.

Among other objects of the present invention there may be mentioned the broad objective of reducing wastage of heat by improving window sealing; and the narrow objective of providing a window frame construction embodying a tape of seal gasket which can be made from a plurality of different materials.

Still other objects, features and attendant advantages of the present invention will become apparent to those skilled in the art from a reading of the following detailed description embodiments constructed in accordance therewith, taken in conjunction with the accompanying drawings.

DESCRIPTION OF THE PREFERRED EMBODIMENT

Figure 1:
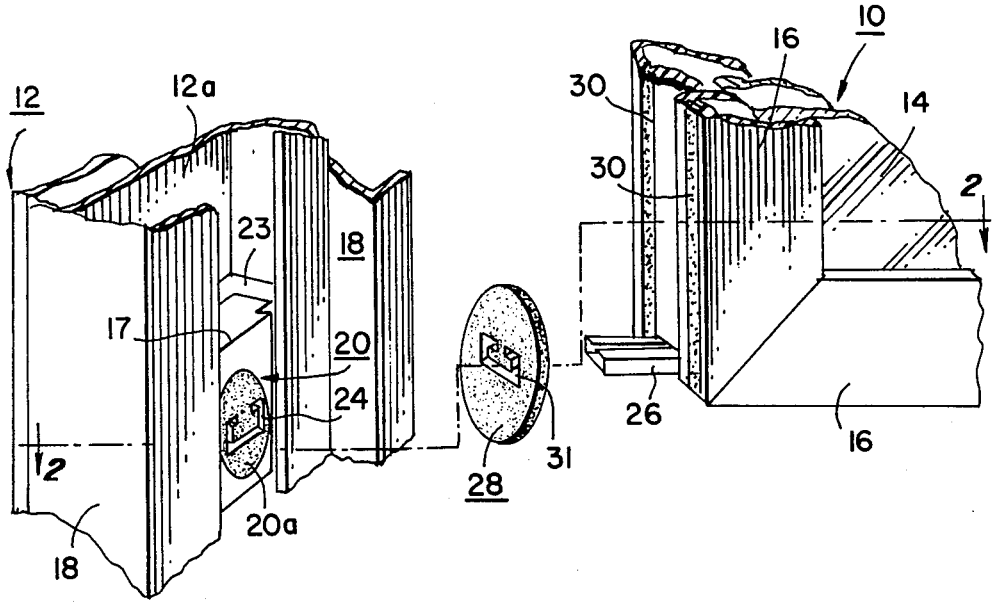
FIG. 1 is a partially broken away exploded perspective view of the single sash tilt-in/tilt-out window assembly equipped with a weatherseal gasket according to the present invention.
Figure 2:
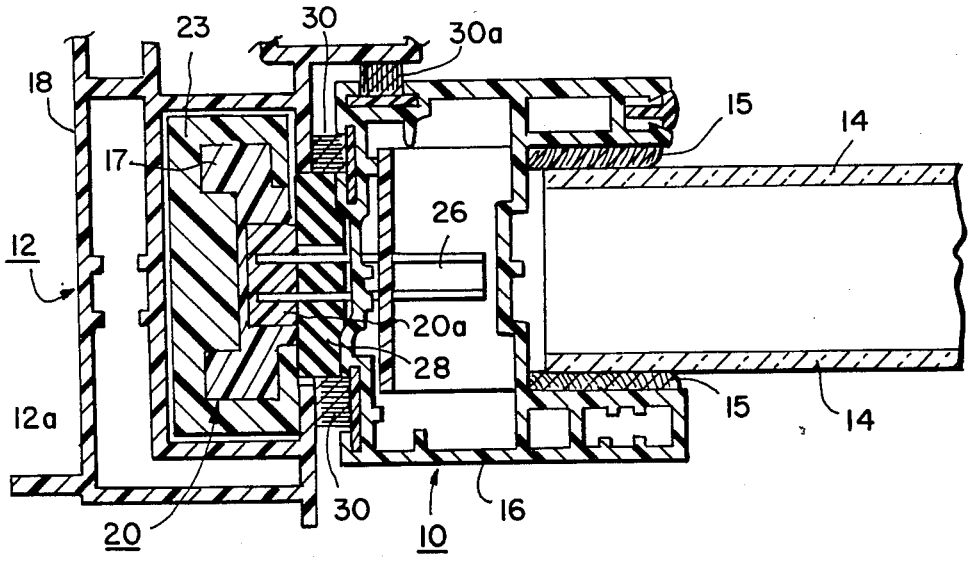
FIG. 2 is a partial cross-sectional view of an assembled single sash tilt-in/tilt-out window assembly with weatherseal gaskets according to the present invention, taken generally along line 2—2 in FIG. 1.

The presently preferred embodiment of the present invention is illustrated in FIGS. 1 and 2 of the drawings. The invention generally comprises the combination of a window sash 10, a window frame or jamb 12, a pivot bar 26 integral with the window sash 10, a shoe 20 integrally assembled with the window jamb 12, and a weatherseal gasket 28 adapted to be positioned on and encircling the pivot bar 26 between the sash 10 and the shoe 20 of the window jamb 12.

Window sash 10 of a typical conventional extruded aluminum or plastic structure includes hollow sash members 16, 16 for mounting one or more glass panes 14, 14 therein. The glass panes 14, 14 may include conventional weatherstripping 15, 15 or the like along the regions where the panes 14, 14 meet the window sash 10. Generally located near the bottom sash member is an integral pivot bar 26 extending horizontally so as to project within the frame or jamb 12. As shown in FIG. 1, the pivot bar 26 is adapted to extend flush with the bottom horizontal sash member 16, although other positions of bar extension are possible. The pivot bar 26 includes a generally C-shaped cross-section, although other cross-sectional configurations are typically possible. The pivot bar 26 should be made from a high strength metal such as from aluminum or steel, or any other suitable material which is rigid and that can withstand any forces acting thereon, such as the weight of the window sash acting on the pivot bar.

Window frame or jamb 12, also of a typical conventional aluminum or plastic material, includes frame members 18, 18 which generally extend in an upright vertical direction parallel to vertical frame member 16 of the window sash 10, the jamb including a longitudinally extending C-shaped channel 12*a* which extends from the window sill (not shown) to the top of the window jamb within which the shoe 20 slides in a double-hung, slidable construction. For non-slidable constructions at a location directly adjacently opposing the pivot bar 26 of the sash 10, the channel 12*a* includes the shoe 20 which is affixed, e.g. adhesively attached, frictionally positioned and otherwise mechanically anchored, within the C-shaped channel in the jamb 12. The C-shaped channel 12*a* includes an internal peripherally positioned shoe housing or shoe positioning means 23 for locating the shoe 20 properly within the channel 12*a*. The shoe positioning means is essentially an integrally formed horizontally extending molding having a generally C-shaped cross-section as shown in FIG. 2, and within which the shoe 20 is recessed. It should be understood that the shoe 20 and the shoe positioning means 23 may be formed from the same material employed in making the jamb or could be made from any other suitably rigid material. The shoe 20 includes a rotatable disk portion 20*a* having a generally C-shaped aperture 24 for receiving the C-shaped pivot bar 26. The disk portion 20*a* is in turn rotatably supported by a stationary body portion 17 of the shoe 20, the body portion 17 being tightly gripped by the shoe housing 23.

The gasket seal 28, also equipped with a centrally located C-shaped aperture 31 therethrough, is also adapted to receive the pivot bar 26 therethrough, thereby entirely encircling or surrounding the pivot bar at a position between the shoe 20 and the window sash vertical frame member 16 and especially filling the "chimney" recess therebetween. It should be understood that the gasket seal not only seals the space between the disk portion 20*a* of the shoe, the pivot bar and the sash, but also seals the space between the shoe stationary body 17 and the sash 10.

The gasket 28 may be formed of any suitable sealing material, such as from plastic foam, paper, felt, rubber, cloth or other soft and flexible plastic which can suitably deform and block the "chimney" thereby eliminating the passage of air which might act to penetrate through the window assembly. The seal 28 may desirably have a thickness of about 3/16–¼ inch and be compressible to generally fill the void between the jamb 12 and the sash 10 of the window, particularly the internal groove or "chimney" at the region where the pivot bar 28 mates with the shoe 20 of the jamb lying between elongated weather-stripping elements 30.

Referring now to FIG. 2 of the drawings, which shows in cross-section the assembled sash 10, pivot bar 26, shoe 20, gasket seal 28 and jamb 12, it is clearly seen that the jamb 12 defines internally thereof the C-shaped longitudinally extending channel 12*a* having its open side opposing the vertical hollow sash member 16 of the sash 10, such channel 12*a* opposing the pivot bar of the sash and supporting the shoe housing 23 with the shoe 20 therein for receiving and rotatably securing the pivot bar. Also, as noted above, the shoe 20 essentially includes two distinct parts, namely the stationary body portion 17 which is mated with the shoe housing 23 and the rotatable circular disk 20*a*, the latter being adapted to be positioned within a complementary circular hole of the body portion 17.

The gasket seal 28 of the preferred embodiment has a generally circular cylindrical shape having a diameter somewhat greater than the diameter of the circular disk 20*a* so that proper sealing of the chimney space between the shoe and the sash, i.e. the diameter of the gasket should be as wide as the space of the opening of the C-shaped channel 12*a* in the jamb 12. The gasket may have a thickness equal to or slightly less or more than the distance between the shoe and the sash, e.g. 3/16 to ¼ inch as indicated above, but preferably should have a thickness generally equal to the distance between the shoe face opposing the pivot bar and the window sash.

Figure 3A:
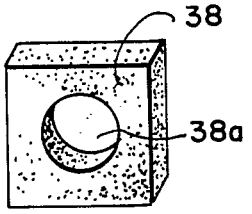
FIG. 3*a* is a perspective view of a weatherseal gasket employed in the present invention.
Figure 3B:
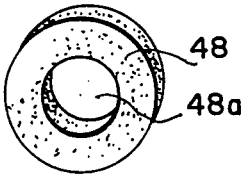
FIG. 3*b* is a perspective view of a second embodiment of a weatherseal gasket employed in the present invention.
Figure 3C:
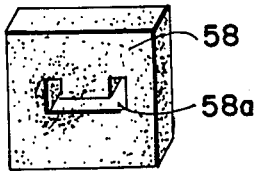
FIG. 3*c* is a perspective view of a third embodiment of a weatherseal gasket employed in the present invention.

Referring now to FIGS. 3*a*–3*f* of the drawings, which show various configurations of the gasket seal employed in the present invention, FIG. 3*a* shows a generally square-shaped gasket 38 having a centrally located circular aperture 38*a* therethrough for receiving a pivot bar having a circular cross-section. FIG. 3*b* shows a generally circular shaped gasket 48 having a centrally located aperture 48*a* therethrough also for receiving a pivot bar having a circular cross-section. FIG. 3*c* illustrates a generally square-shaped gasket 58 having a centrally located C-shaped aperture 58*a* therethrough for receiving a pivot bar having a C-shaped cross-section.

Figure 3D:
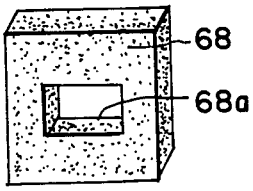
FIG. 3*d* is a perspective view of a fourth embodiment of a weatherseal gasket employed in the present invention.
Figure 3E:
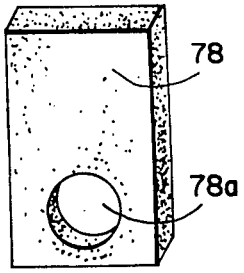
FIG. 3*e* is a perspective view of a fifth weatherseal gasket employed in the present invention.
Figure 3F:
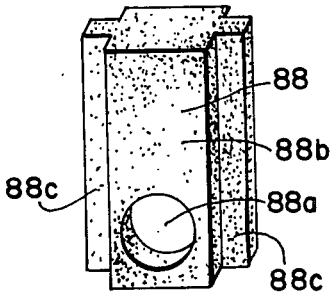
FIG. 3*f* is a perspective view of a sixth weatherseal gasket employed in the present invention.

FIG. 3*d* shows a generally square-shaped gasket 68 having a centrally located square-shaped aperture 78*a* for receiving a pivot bar having a square-shaped cross-section. FIG. 3*e* illustrates a rectangular-shaped gasket 78 having an off-center located aperture 78*a* for receiving a pivot bar having a circular cross-section. And FIG. 3*f* shows a generally rectangular-shaped gasket 88 having a centrally extending thick portion 88*b* and narrower lengthwise edge flanges 88*c*, 88*c*, and an off-center located aperture 88*a* for receiving a pivot bar having a generally circular cross-section. The gaskets, particularly shown in Figs. 3*c* and 3*f*, are elongated to ensure good blockage of the chimney between the sash 10 and the frame 12.

Figure 3G:
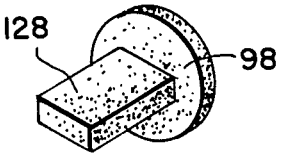
FIG. 3*g* is a perspective view of a variation based on a weatherseal gasket integral with a pivot bar.

FIG. 3*g* illustrates a variant wherein a weatherseal gasket 98 is made integral with the base of the pivot bar 128 at the location from which it projects from the sash.

As shown best in FIG. 2, sash assembly 10 preferably includes the weatherstripping elements 30, 30, positioned on both sides of gasket 28, and attached to the sash 10 in a conventional manner, to insure a proper complete seal of the window assembly from ambient conditions.

It should be understood that the present invention also encompasses doubled sashed window assemblies, in which case a weather stripping element 30*a* is attached to sash 10 to seal the space between the sashes. In the double-sash or double-hung arrangement where each sash typically slides up and down, jamb 12 must be configured so as to enable a second sash (not shown) pivot bar mounting therein (in a second C-shaped channel). It should be understood that various other configurations of gasket seal may be utilized to conform to many different dimensioned cross-sections of the pivot bar which might arise in stock tilt-in/tilt-out window assemblies.

Furthermore, it should also be understood that the gasket of the present invention can be easily installed, in situ, at the manufacturer or at the window installation site. Furthermore, in tilt-in/tilt-out windows wherein the sash is removable from the jamb assembly, the gaskets can readily and easily be installed and replaced by homeowners by simply disconnecting the pivot bar from the shoe of the jamb and slipping the gakset over the exposed end of the pivot bar, and then reinserting the bar end into the apertured rotatable disk 22.

While the present invention is directed to weatherized gaskets for use with tilt-in/tilt-out window assemblies, more particularly for use on pivot bars thereof, it should be understood that the seal gaskets could be employed on any pivot bar employed in tiltable or pivotal barrier structures or members which might have an advantageous use of utilizing a seal to block the passage of coil air therethrough. The present invention is directed to pivot bars for use with tilt-in/tilt-out window assemblies only for illustrative purposes in describing one use of the present invention.

It will be obvious to those skilled in the art that various other changes and modifications may be made without departing from the scope of the invention and the invention is not be considered limited to what is shown in the drawings and described in the specification.

What is claimed is:

1. A tilt-in/tilt-out window assembly comprising:

a sash having at least a horizontally extending lower frame member, said frame member having a horizontal longitudinal axis and a first end and a second end;

a pivot bar integral with at least said first end and adapted to extend horizontally beyond said first end, said pivot bar being parallel to said longitudinal axis of said lower frame member and having a cross-section and a first end;

at least one vertically erect jamb having a vertical longitudial axis and an integrally formed vertically extending channel, said channel having an opening opposing said sash, said jamb being perpendicular and adjacent to said sash lower frame member;

a shoe, within said channel fo said jamb and positioned at a location directly opposing said pivot bar, for receiving said first end of said pivot bar, said shoe having a surface face opposing said pivot bar and including at least a first member stationary relative to said pivot bar and having a centrally located recess for receiving a rotatable movable member including a centrally located aperture having a configuration shaped to that of said cross-section of said pivot bar, said opposing face of said shoe being in a plane flush with said channel opening; and a flexible and resilient weatherseal gasket positioned on and entirely encircling said pivot bar between said shoe of said jamb and said first end of said sash frame member, having a centrally located aperture therethrough having a configuration shaped to that of said pivot bar cross-section, said gasket having a diameter or width at least equal to the width of said channel in said jamb, whereby said gasket is adapted to seal the junction between said pivot bar and said shoe, thereby preventing air penetration.

2. A window assembly in accordance with claim 1, wherein said channel of said jamb further includes a shoe housing for positioning and holding said shoe in said channel.

3. A window assembly in accordance with claim 1, wherein said gasket is formed of a compressible weather sealing material.

4. A window assembly in accordance with claim 1, wherein said gasket includes a centrally located aperture therethrough having a circular configuration.

5. A window assembly in accordance with claim 1, wherein said gasket includes an off-center located aperture therethrough having a circular configuration.

6. A window assembly in accordance with claim 1, wherein said gasket includes an aperture therethrough having a rectangular configuration.

7. A window assembly in accordance with claim 1, wherein said gasket includes an aperture therethrough having a C-shaped configuration.

8. A window assembly in accordance with claim 1, wherein said gasket includes a central rectangular body having lengthwise flanges integral therewith on either side of said body, said flanges having a thickness somewhat less than said body.

9. A window assembly in accordance with claim 1, wherein said gasket is integral with said pivot bar.

10. A tilt-in/tilt-out window assembly comprising an outside extruded vinyl or aluminum frame and at least one slidable tilt-in/tilt-out window sash retained in said frame, said sash having a pair of pivot bars extending laterally therefrom and projecting into said extruded frame, a pair of shoe elements supported within said frame and receiving said pivot bars for rotation of said sash about said pivot bars to effect the tilt-in/tilt-out function, said extruded frame and said sash defining a pair of chimney-like grooves therebetween through which said pivot bars extend, and a flexible and resilient weatherseal gasket surrounding each said pivot bar and blocking the chimney-like grooves.

11. A window assembly according to claim 10, wherein each said weatherseal gasket is compressed within one of said grooves.

* * * * *